US011027209B2

(12) United States Patent
Andreyev et al.

(10) Patent No.: US 11,027,209 B2
(45) Date of Patent: Jun. 8, 2021

(54) AMUSEMENT RIDE

(71) Applicants: Nikolay Gennadyevich Andreyev, Almaty (KZ); Kairat Amangeldiyevich Yestayev, Almaty (KZ)

(72) Inventors: Nikolay Gennadyevich Andreyev, Almaty (KZ); Kairat Amangeldiyevich Yestayev, Almaty (KZ); Yuliya Yevgenyevna Levitskaya, Almaty (KZ); Eldar Dauletovich Shibanov, Almaty (KZ); Dias Dauletovich Shibanov, Almaty (KZ)

( * ) Notice: Subject to any disclaimer, the term of this patent is extended or adjusted under 35 U.S.C. 154(b) by 23 days.

(21) Appl. No.: 16/630,843

(22) PCT Filed: Nov. 17, 2017

(86) PCT No.: PCT/KZ2017/000024
§ 371 (c)(1),
(2) Date: Jan. 13, 2020

(87) PCT Pub. No.: WO2019/017759
PCT Pub. Date: Jan. 24, 2019

(65) Prior Publication Data

US 2020/0139257 A1 May 7, 2020

(30) Foreign Application Priority Data

Jul. 18, 2017 (KZ) ..... 2017/0612.1

(51) Int. Cl.
*A63G 31/02* (2006.01)
*A63G 31/16* (2006.01)

(52) U.S. Cl.
CPC ..... *A63G 31/02* (2013.01); *A63G 31/16* (2013.01)

(58) Field of Classification Search
CPC ..... A63G 31/02; A63G 31/16; A63G 31/10; B66B 31/00; A63B 2200/00; A63J 1/02
(Continued)

(56) References Cited

U.S. PATENT DOCUMENTS 797,372 A * 8/1905 Rice ..... A63G 31/16 472/59
4,695,903 A * 9/1987 Serap ..... G07F 17/28 360/55

(Continued)

FOREIGN PATENT DOCUMENTS

KR 20110139613 12/2011
RU 2002122928 3/2004

(Continued)

OTHER PUBLICATIONS

English Translation of the International Search Report, International Application No. PCT/KZ2017/000024 dated Mar. 22, 2018.

*Primary Examiner* — Michael D Dennis
(74) *Attorney, Agent, or Firm* — The Roy Gross Law Firm, LLC; Roy Gross

(57) ABSTRACT

A visitor compartment equipped with a system of screens, an audio system, a lighting system, a controller, a control console, a video monitoring system and a payment system, the compartment is made in the form of an elevator car having sliding doors and connected to a pneumatic cylinder and compressor for moving, a wall or walls, the ceiling has cells with animatronic objects connected to movement mechanisms and moving panels, the car is equipped with a water-spray device, a device for the supply of directed air flows, a photo camera and/or video camera, a safety and emergency stop system of the amusement ride. The elevator car is equipped with a steam generator and/or smoke machine, a forced air ventilation system, a soap bubble generator, a spark generator. The system of screens is (Continued)

equipped with a holographic projector. The photo camera and/or video camera are connected to the Internet for sending the photo and/or video to the visitor by e-mail or for publication in social networks during the amusement ride.

12 Claims, 3 Drawing Sheets

(58) Field of Classification Search
USPC ..... 463/25, 34, 31; 472/60; 187/414
See application file for complete search history.

(56) References Cited

U.S. PATENT DOCUMENTS 6,074,307 A * 6/2000 Hettema ..... A63J 1/028 472/74
6,076,638 A * 6/2000 Gertz ..... B66B 3/00 187/414
6,431,989 B1 * 8/2002 Katayama ..... A63G 31/16 434/55
6,629,895 B2 * 10/2003 Uemura ..... A63G 31/16 472/131
8,133,103 B2 * 3/2012 Ciarrocchi ..... A63F 13/08 463/1
8,795,096 B2 * 8/2014 Stoker ..... A63J 21/00 472/71
9,266,028 B2 * 2/2016 Alfieri ..... A63G 31/00
9,303,421 B1 * 4/2016 Jennings ..... A63G 31/02
2003/0224333 A1 * 12/2003 Vastvedt ..... G09B 9/165 434/29
2010/0062866 A1 * 3/2010 Schnuckle ..... A63J 1/02 472/78
2012/0258789 A1 10/2012 Ciarrocchi
2013/0058080 A1 3/2013 Ge et al.
2013/0324271 A1 * 12/2013 Stoker ..... A63G 31/10 472/71
2014/0200087 A1 * 7/2014 Vatcher ..... A63G 31/02 472/131
2015/0141161 A1 * 5/2015 Altieri ..... A63G 31/16 472/50
2019/0221036 A1 * 7/2019 Griffin ..... A63F 13/211

FOREIGN PATENT DOCUMENTS

RU 2279300 7/2006
RU 133010 10/2013
RU 134917 11/2013
RU 2546469 10/2014
SU 877254 10/1981
SU 981726 12/1982
WO 2011162448 12/2011

* cited by examiner

B - B

AMUSEMENT RIDE

CROSS REFERENCE TO RELATED APPLICATIONS

This application is a National Phase of PCT Patent Application No. PCT/KZ2017/000024 having International filing date of Nov. 17, 2017, which claims the benefit of priority of Kazakhstan Application No. 2017/0612.1 filed on Jul. 18, 2017. The contents of the above applications are all incorporated by reference as if fully set forth herein in their entirety.

TECHNICAL FIELD

The disclosed embodiment relates to amusement equipment, specifically to an amusement ride in the form of a "chamber of horrors", a dynamic device/elevator simulator, and is intended for human leisure.

BACKGROUND OF THE INVENTION

There is a known amusement ride that is installed, for example, in entertainment centers and comprises a visitor compartment—a game cell, made in the form of three walls, ceiling with an open side. A game cell has a video game system, for example, a football game, a guitar game projected onto a screen or screens on the walls and connected to a controller system, an audio system, a lighting system, a control console, video monitoring systems, a visitor's cell usage time tracking system, and payment system (US 2012258789, IPC A63F/13/02, published on October, 2012).

This amusement ride is intended for playing purposes and does not contain any surprise effects. The space of the game cell is not closed, the cell is installed stationary, there are no dynamic movements of the structure, and the impact of the equipment on the visitor is only visual.

SUMMARY OF THE INVENTION

The idea of the disclosed embodiment is to develop an amusement ride in the form of a "chamber of horrors", which is an elevator simulator, providing for the presence of unexpected effects due to the introduction of moving objects, the possibility of compartment movement for visitors and its elements, air supply, fragrances, which has the ability to make a photograph or video for visitors.

For this purpose, in an amusement ride comprising a visitor compartment equipped with a system of screens, an audio system, a lighting system, a controller, a control console, a video monitoring system and a payment system, according to the disclosed embodiment, visitor compartment is designed as an elevator car having sliding doors, and is connected to a pneumatic cylinder and compressor for its movement, a wall or walls and a ceiling have cells with animatronic objects which are connected to motion mechanisms and moving panels. The car is equipped with a water-spray device, a device for the supply of directed airflows, photo camera and/or video camera, a safety and emergency stop system of the amusement ride.

The amusement elevator car is equipped with a steam generator and/or a smoke machine. The screen can be installed on the floor under safety glass or plastic.

The car is equipped with vertical rails to move the ceiling.

The photo camera and/or video camera are connected to the Internet for sending the photo and/or video to the visitor by e-mail or for publication in social networks during the amusement ride.

The car is equipped with a forced air ventilation system.

The car is equipped with a soap bubble generator.

The car is equipped with a spark generator. The spark generator is equipped with an audio system.

The system of screens is equipped with a holographic projector.

The lighting system is made in the form of multi-color (RGB+W) diode tape.

The elevator car is installed in the housing.

The new design of the amusement ride, equipped with these devices and appliances, is a "chamber of horrors", an elevator simulator, a device that supports the movement elements, suddenly appearing moving animatronic objects, for example, in the form of fantasy characters, scenes on the screens, unexpected effects—directional airflow, sparks, soap bubbles, fragrances that provide visitors who love the elements of extreme entertainment, fully immersed in an atmosphere full of "strong" impressions.

BRIEF DESCRIPTION OF THE DRAWINGS

The drawings show the proposed device, FIG. 1 schematically depicts the cross section of the amusement ride when placing the elevator car in the housing with sliding doors.

DETAILED DESCRIPTION OF THE INVENTION

Figure 1:
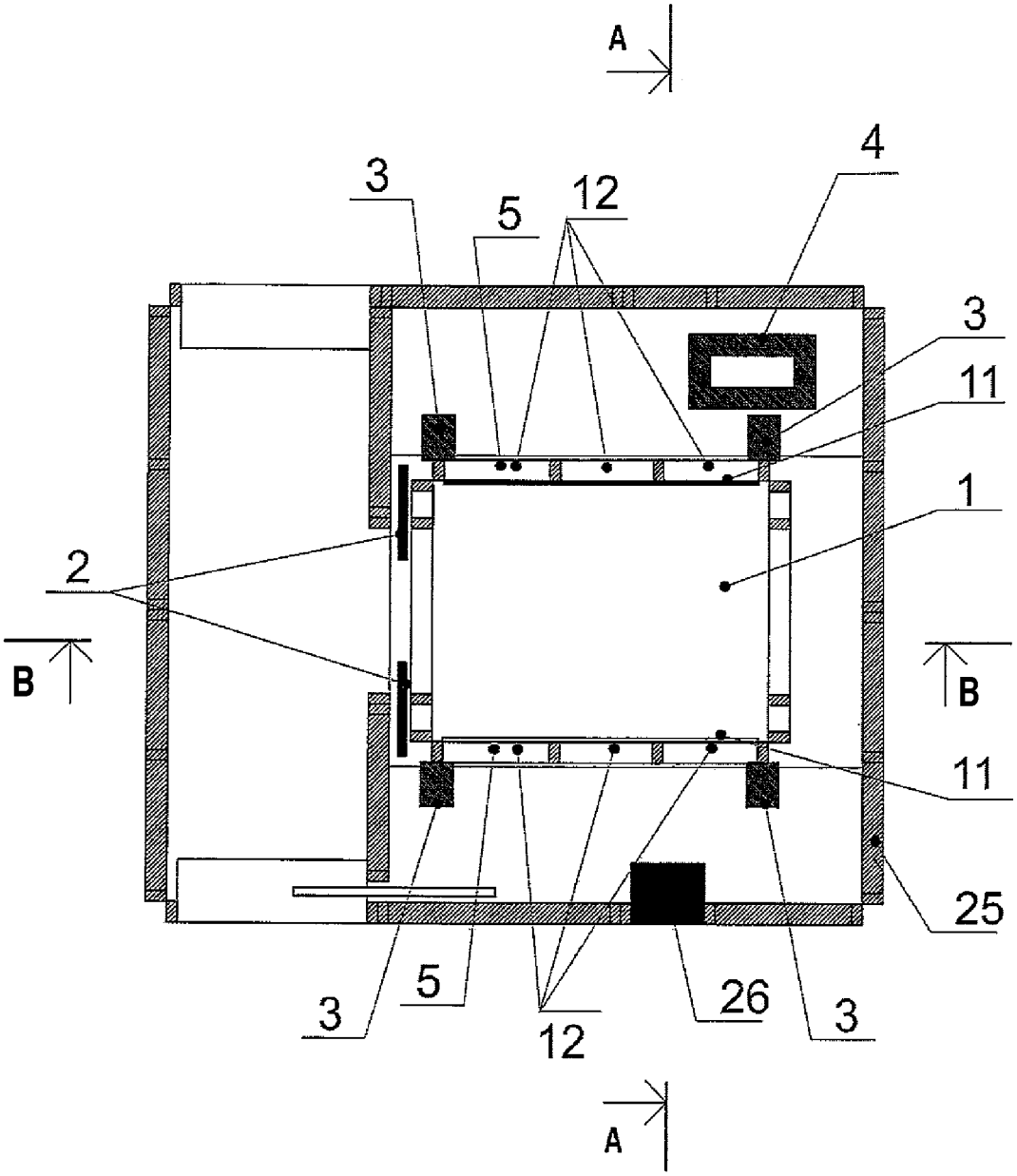
Figure 2:
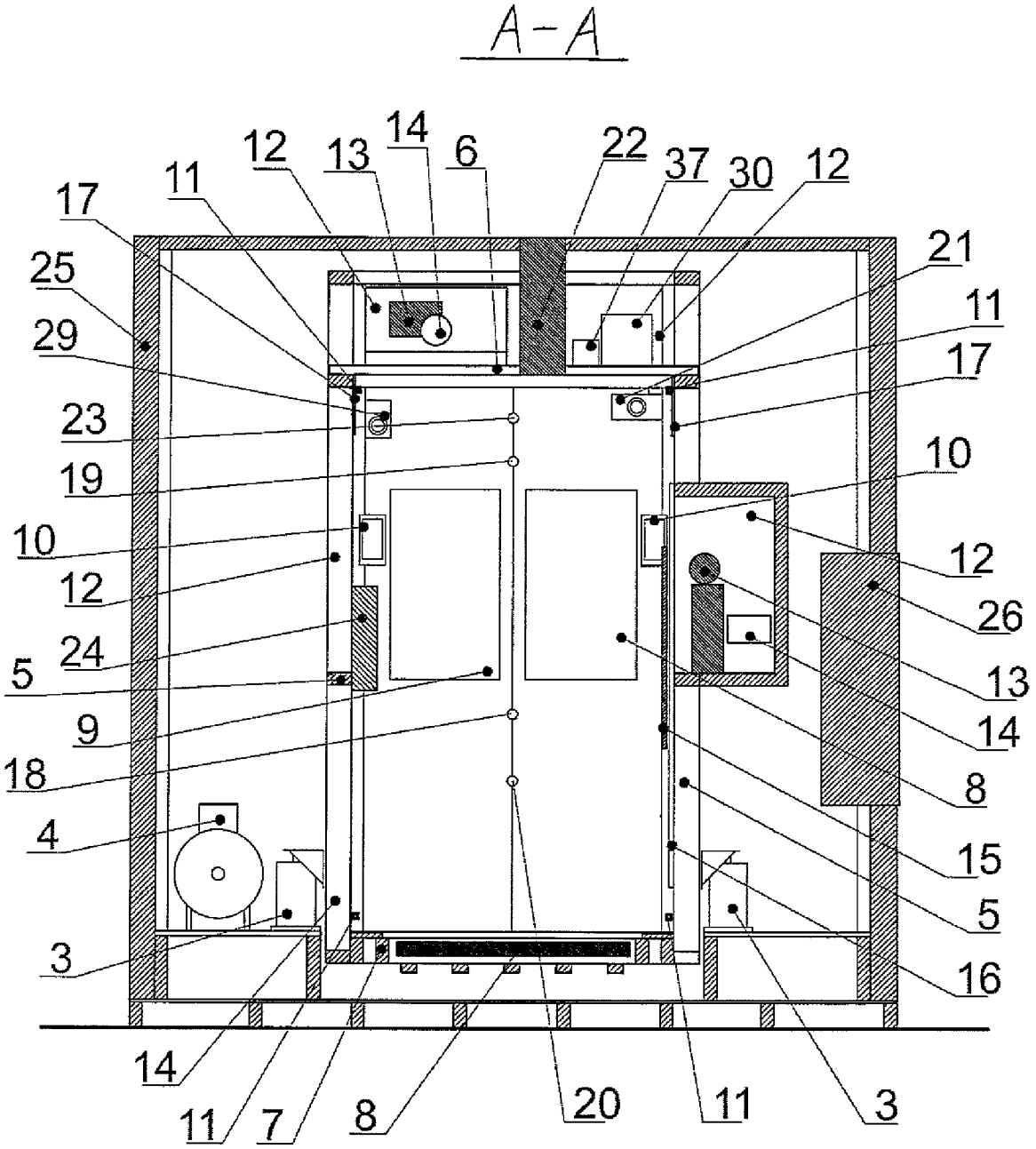
in FIG. 2—section A-A in FIG. 1.
Figure 3:
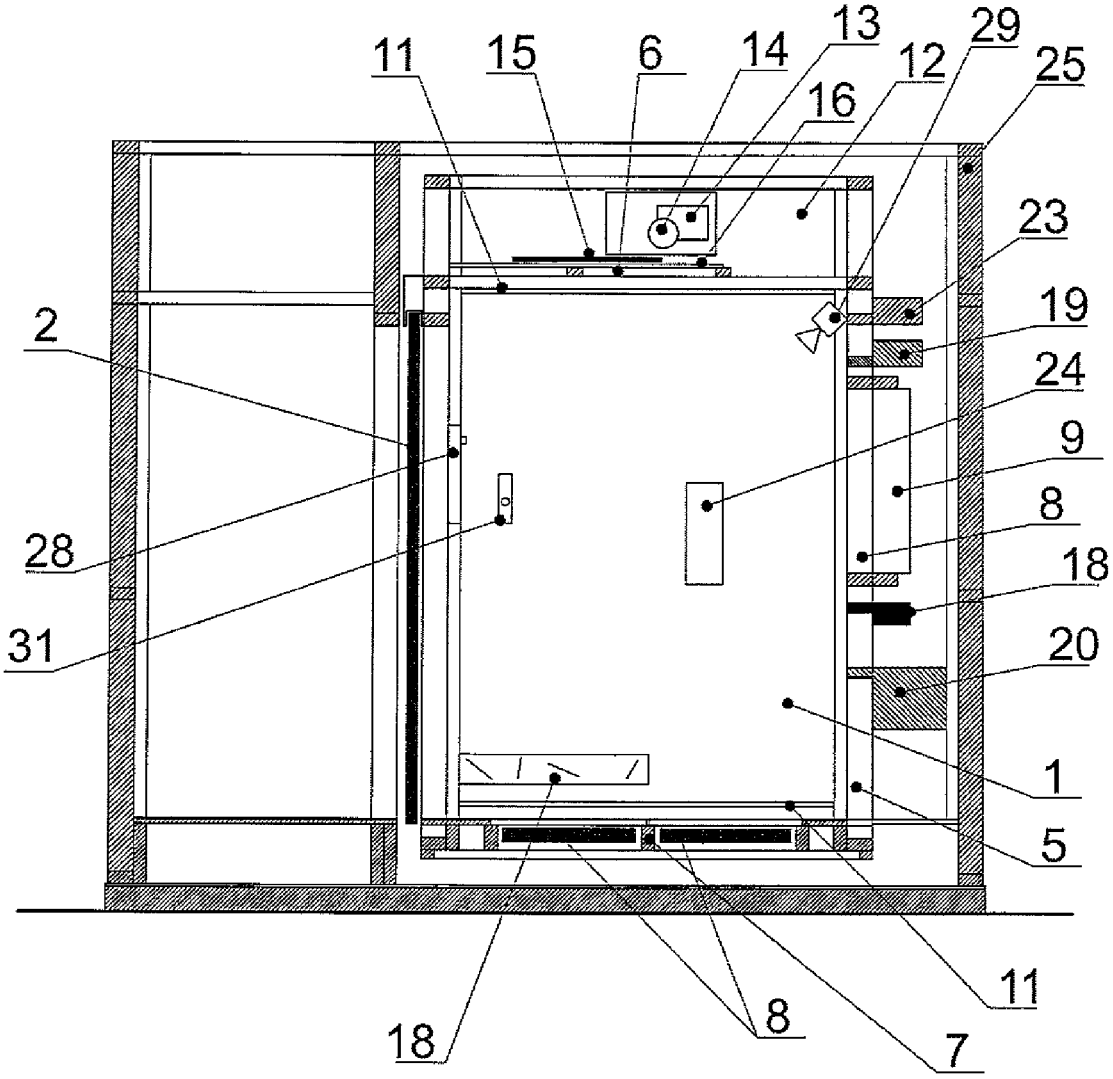
in FIG. 3—section B-B in FIG. 1.

The proposed amusement ride consists of the elevator car 1, which has automatic sliding doors 2 for visitors to enter; the car 1 is connected to a pneumatic cylinder 3 and compressor 4 to move it. The walls of the car 5 and/or ceiling 6 as well as the floor of the car 7 are equipped with a system of screens 8, which can, for example, simulate windows or openings. Screens 8 are protected with safety glass or plastic. The system of screens 8 is equipped with a holographic projector 9. The audio system 10 and the lighting system 11 in the form of, for example, a multi-color (RGB+W) diode tape, are built into the walls 5 of the car 1. Multi-color (RGB+W) diode tape provides a wide range of colors and has low power consumption.

The wall or walls 5 of the car 1, as well as the ceiling 6, have cells 12 with animatronic objects 13, for example, in the form of figures of movie characters, which are connected to movement mechanisms—pneumatic cylinders or servomotors 14. The animatronic objects 13 in a static state are hidden behind the moving panels 15 of walls 5, ceiling 6, and at the right moment, actions appear in the car 1 in front of visitors. The moving panels 15 are mounted on rails 16. The appearance time of animatronic objects 13 is regulated by a timeline, built into the software, or with the help of the controller at the attraction operator. The car 1 is equipped with vertical rails 17 to move the ceiling 6 to reduce the height of the car 1.

There is a device for supplying directed airflows 18 installed in the elevator car 1, which serves to maintain the effect carried in the car space. The car 1 is also equipped with a water-spray device 19, which creates an imitation of interaction effects necessary for the scenario with various types of liquids, such as rain, blood. The car 1 is equipped with a steam generator or smoke machine 20 to supply, for example, safe steam or smoke, as well as fragrances—such as the smell of raw dungeon, ocean air, freshly cut grass.

The screen 8 in the form of a high-definition TV, for example, can be mounted on the floor 7 under a protective glass.

A photo camera, such as a digital and/or video camera 21, is connected to the Internet for sending the photo and/or video to the visitor by e-mail or for publication in social networks during the amusement ride.

The car 1 is equipped with forced air ventilation 22, for example, in the form of a fan, built into the wall 5 or ceiling 6, or in the form of supply and exhaust ventilation with ducts. The car 1 has a soap bubble generator 23, a spark generator 24, which can be equipped with an audio system (not shown in the drawing).

The car 1 can be located in a separate external enclosure 25, or can be built into an existing compartment.

The amusement ride has a payment system 26, a controller 27 connected to all the amusement ride devices, a control system with the possibility of on-site control using the control console 28, and remotely through software, a video surveillance system 29, combined with a security system 30, including a fire and burglar alarm and emergency stop system. An additional emergency stop button 31 is installed in the cabin 1.

The proposed amusement ride is the "chamber of horrors", the elevator simulator works as follows. After making a payment to the payment system of the amusement ride 26 visitor gets into the elevator car 1. The amusement ride is started with the help of controller 27, located at the sliding door 2 in the car 1. All of the above devices and systems are controlled by the software loaded into the automated control system with console 28. After the amusement ride start, screens 8 broadcast video of the starting movement, and the car 1 begins to move and the characteristic vibrations with pneumatic cylinders 3. In the movement of pneumatic cylinders 3, in addition to the uniform movement, asynchronous movements and rolls are programmed, which correspond to the story loaded into the automated control system with the console 28. All movements, as the car 1, animatronic objects 13, as well as actions displayed in the system of screens 8, are accompanied by audio and light effects, synchronized with each other.

During the amusement ride, with the photo camera and/or video camera 21 installed in the car, the material is sent to an e-mail address and/or published on the page in the visitor's social network. The video surveillance system 29, combined with security system 30, which includes fire and security alarm system constantly regulates and monitors the situation inside the car 1 of the amusement ride. The security system 30 is activated at the moment of an emergency situation, which stops the amusement ride in an emergency way, opens the doors for evacuation, turns on the emergency lighting, indicating the way to evacuation. Also, inside the car, emergency stop button 31 allows the visitor to interrupt the session and leave the compartment at any time.

The aggregate motion of the car 1, visual images on screens 8, sound, light and air effects, creates the illusion of moving the passengers of the amusement ride in space, which strongly affects the psycho-emotional state and provides full disclosure of the feeling of joy and fear, the concentrated process of adrenaline and endorphin production by the human body.

The sudden appearance of animatronic objects 13—characters, creatures and/or effects creates a full immersion into the atmosphere and the action of the story, which is currently running in the amusement ride.

The invention claimed is:

1. An amusement ride comprising: a visitor compartment, equipped with a system of screens, an audio system, a lighting system, a controller, a control console, a video monitoring system, and a payment system, wherein the visitor comprises an elevator simulator car having sliding doors; wherein the elevator simulator car has a wall or walls and a ceiling; wherein the elevator simulator car is connected to pneumatic cylinders and to a compressor; wherein the pneumatic cylinders are located outside the elevator simulator car in at least one of a plurality of walls of the amusement ride; wherein the pneumatic cylinders are programmed for an asynchronous movement and rolls of the elevator simulator car; wherein the wall or walls and the ceiling of the elevator simulator car have cells with animatronic objects connected to pneumatic cylinders or servomotors, and the animatronic objects are hidden behind moving panels; wherein the elevator simulator car is equipped with a water-spray device, a device for supplying directed airflows, a photo camera and/or a video camera, a safety and emergency stop system of the amusement ride.

2. The amusement ride according to claim 1, wherein the elevator simulator car is equipped with a steam generator and/or a smoke machine.

3. The amusement ride according to claim 1, wherein a screen is installed on a floor of the elevator simulator car, under a safety glass or plastic.

4. The amusement ride according to claim 1, wherein the elevator simulator car is equipped with vertical rails to move the ceiling.

5. The amusement ride according to claim 1, wherein the photo camera and/or video camera is connected to a Internet for sending a photo and/or a video to the visitor by e-mail or for publication in social networks during the amusement ride.

6. The amusement ride according to claim 1, wherein the elevator simulator car is equipped with a forced air ventilation system.

7. The amusement ride according to claim 1, wherein the elevator simulator car is equipped with a soap bubble generator.

8. The amusement ride according to claim 1, wherein the elevator simulator car is equipped with a spark generator.

9. The amusement ride according to claim 8, wherein the spark generator is equipped with an audio system.

10. The amusement ride according to claim 1, wherein the system of screens is equipped with a holographic projector.

11. The amusement ride according to claim 1, wherein the lighting system comprises a multi-color (RGB+W) diode tape.

12. The amusement ride according to claim 1, wherein the elevator simulator car is installed in a housing.

* * * * *